US006000149A

United States Patent [19]

Pomerantz

[11] Patent Number: 6,000,149

[45] Date of Patent: Dec. 14, 1999

[54] AUDIO SHOE

[76] Inventor: David Pomerantz, 251 174th St., Apt. 504, Miami Beach, Fla. 33160

[21] Appl. No.: 09/183,777

[22] Filed: Oct. 30, 1998

[51] Int. Cl.[6] ..... A43B 23/00

[52] U.S. Cl. ..... 36/139; 36/136

[58] Field of Search ..... 36/136, 137, 139

[56] References Cited

U.S. PATENT DOCUMENTS

| | | | |
|---|---|---|---|
| 4,043,241 | 8/1977 | Liu | 36/139 |
| 4,646,350 | 2/1987 | Batra . | |
| 4,771,556 | 9/1988 | Kim | 36/139 |
| 5,159,768 | 11/1992 | Longo, Jr. . | |
| 5,345,700 | 9/1994 | Norment . | |
| 5,396,720 | 3/1995 | Hwang et al. | 36/139 |
| 5,402,590 | 4/1995 | Lee . | |
| 5,422,628 | 6/1995 | Rodgers | 36/139 |
| 5,692,324 | 12/1997 | Goldston et al. | 36/137 |
| 5,765,300 | 6/1998 | Kianka | 36/139 |
| 5,855,080 | 1/1999 | Van Staden | 36/139 |

*Primary Examiner*—M. D. Patterson

*Attorney, Agent, or Firm*—Jack Lo

[57] ABSTRACT

An audio shoe includes a shoe top attached to a sole, and a channel extending into the sole from a side edge thereof. A speaker attached to a housing is positioned inside the channel. The speaker is oriented with its axis in a vertical position. A slot is provided between the front of the speaker and the side edge of the sole to enable sound to escape. The diameter of the speaker may be up to the width of the sole, which is large enough to provide improved sound volume and quality. In a first embodiment, the housing includes audio circuitry and user controls. In a second embodiment, a separate audio module is attached to the shoe top, and connected to the speaker with a cable. In a third embodiment, curved vertical supports extend between the top and bottom walls of the channel to provide additional shock absorption. In a fourth embodiment, a mesh is provided across the opening of the channel for shielding the speaker from dirt and water. In a fifth embodiment, a mesh is provided across the opening of the channel, and a sliding door attached to the side edge of the heel may be slid over the mesh to completely seal out dirt and water.

20 Claims, 2 Drawing Sheets

AUDIO SHOE

BACKGROUND OF THE INVENTION

1. Field of the Invention

This invention relates generally to shoes with built-in audio devices.

2. Prior Art

Miniature audio devices have been incorporated into shoes to provide music and sound effects. U.S. Pat. Nos. 5,402,590 to Lee; 5,159,768 to Longo, Jr.; and 4,646,350 to Batra each show a musical module arranged in the tongue of a shoe. The size of the speaker is limited by the narrow width of the tongue, so that the sound volume and quality are limited. The modules also make the tongue bulky, stiff, and uncomfortable. U.S. Pat. No. 5,345,700 to Norment shows an audio module slipped into a pocket on the side of a shoe. The speaker must be very small to fit into the thin, narrow pocket, so that the sound volume and quality are also limited. U.S. Pat. No. 4,771,556 to Kim also shows an audio module mounted to the side of a shoe. The speaker is mounted on the side edge of the heel with its axis positioned horizontally. The speaker diameter is thus limited to the height or thickness of the heel, so that the sound volume and quality are again limited.

OBJECTS OF THE INVENTION

Accordingly, objects of the present audio shoe are:

to provide audio entertainment and information;

to include a housing which is removable from the shoe for battery replacement;

to be easy to operate;

to operate reliably in dirty or wet environments;

to be as comfortable as a conventional shoe; and to provide enough shock absorption.

Further objects of the present invention will become apparent from a consideration of the drawings and ensuing description.

BRIEF SUMMARY OF THE INVENTION

An audio shoe includes a shoe top attached to a sole, and a channel extending into the sole from a side edge thereof. A speaker attached to a housing is positioned inside the channel. The speaker is oriented with its axis in a vertical position. A slot is provided between the front of the speaker and the side edge of the sole to enable sound to escape. The diameter of the speaker may be up to the width of the sole, which is large enough to provide improved sound volume and quality. In a first embodiment, the housing includes audio circuitry and user controls. In a second embodiment, a separate audio module is attached to the shoe top, and connected to the speaker with a cable. In a third embodiment, curved vertical supports extend between the top and bottom walls of the channel to provide additional shock absorption. In a fourth embodiment, a mesh is provided across the opening of the channel for shielding the speaker from dirt and water. In a fifth embodiment, a mesh is provided across the opening of the channel, and a sliding door attached to the side edge of the heel may be slid over the mesh to completely seal out dirt and water.

Figure 1:
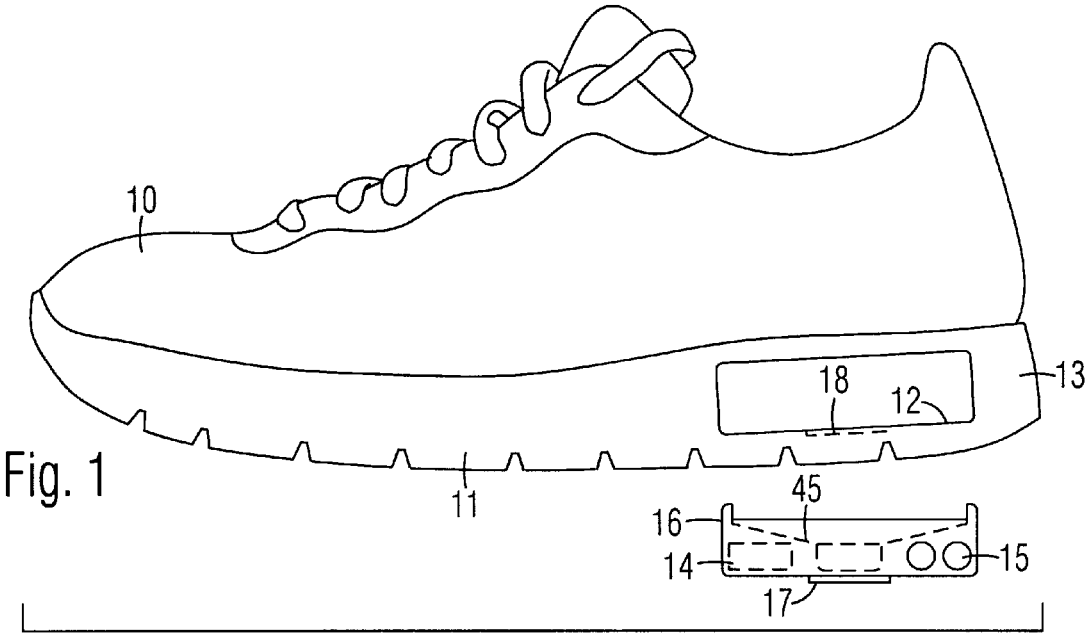
FIG. 1 is a side exploded view of a first embodiment of the present audio shoe.

| DRAWING REFERENCE NUMERALS | |
|---|---|
| 10. Shoe Top | 11. Sole |
| 12. Channel | 13. Heel |
| 14. Audio Circuitry | 15. Controls |
| 16. Housing | 17. Clip |
| 18. Notch | 19. Slot |
| 20. Speaker | 21. Housing |
| 22. Channel | 23. Heel |
| 24. Sole | 25. Audio Module |
| 26. Controls | 27. Shoe Top |
| 28. Tongue | 29. Cable |
| 30. Plug | 31. Housing |
| 32. Speaker | 33. Channel |
| 34. Heel | 35. Sole |
| 36. Shoe Top | 37. Mesh |
| 38. Channel | 39. Shoe Top |
| 40. Mesh | 41. Channel |
| 42. Sliding Door | 43. Sole |
| 44. Shoe Top | 45. Speaker |
| 46. Vertical Supports | |

DETAILED DESCRIPTION OF THE INVENTION

FIGS. 1–2:

A first embodiment of the present audio shoe is shown in the side exploded view in FIG. 1. It includes a shoe top 10 and a sole 11. A channel 12 extends into the side edge of sole 11, preferably at a heel portion 13 where sole 11 is thickest. Channel 12 may extend through both side edges of sole 11, or it may be open at one end and closed at the other end. A speaker 45, conventional audio circuitry 14, and user controls 15 are connected to each other and arranged in a housing 16. Audio circuitry 14 may be any suitable circuitry, such as a preprogrammed music or speech module, or a radio receiver which preferably includes digital tuning. Speaker 45 is a conventional speaker with a diameter or width which is much greater than its thickness.

Figure 2:
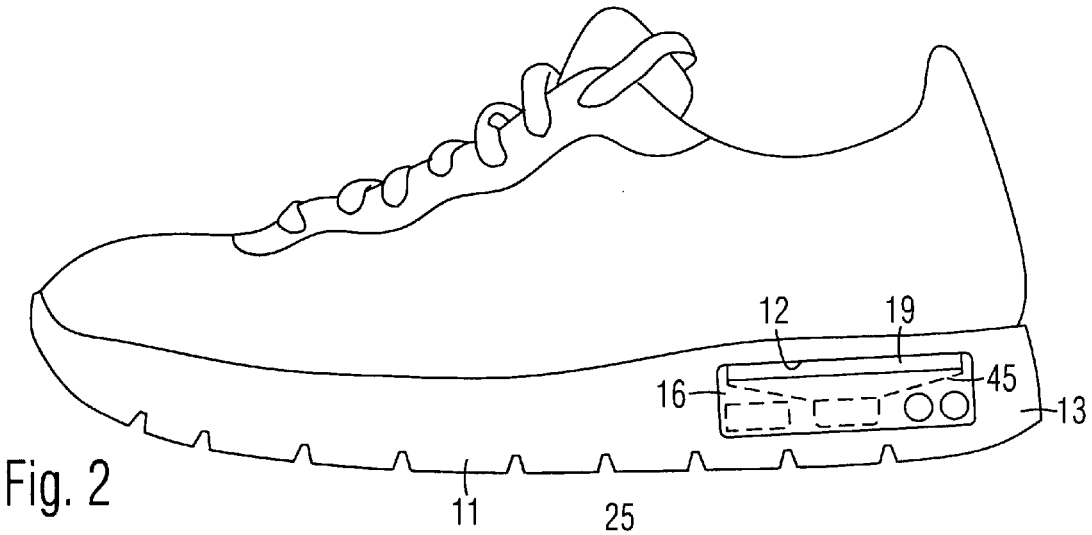
FIG. 2 is a side view of the audio shoe of FIG. 1 assembled.

Housing 16 is removably inserted into channel 12, and secured therein by a clip or tab 17 engaging a notch 18 on a wall of channel 12. Housing 16 may be removed from channel 12 for replacing the battery (not shown). Alternatively, housing 16 may be permanently attached within channel 12. When housing 16 is installed in channel 12, user controls 15 are within easy reach, as shown in FIG. 2. Speaker 45 is arranged within channel 12 with its axis positioned vertically. The front of speaker 45 is preferably directed upwardly toward the ears of the user, although it may also be directed downwardly. Housing 16 and channel 12 are shaped such that a slot 19 is formed between the face of speaker 45 and the side edge of sole 11 to enable sound to escape. The vertical orientation of the speaker axis enables the use of a larger speaker with a diameter of up to the width of sole 11 for improved sound volume and quality. Because housing 16 is positioned in heel portion 13, which does not flex or bend during normal wear, housing 16 does not reduce comfort.

Figure 3:
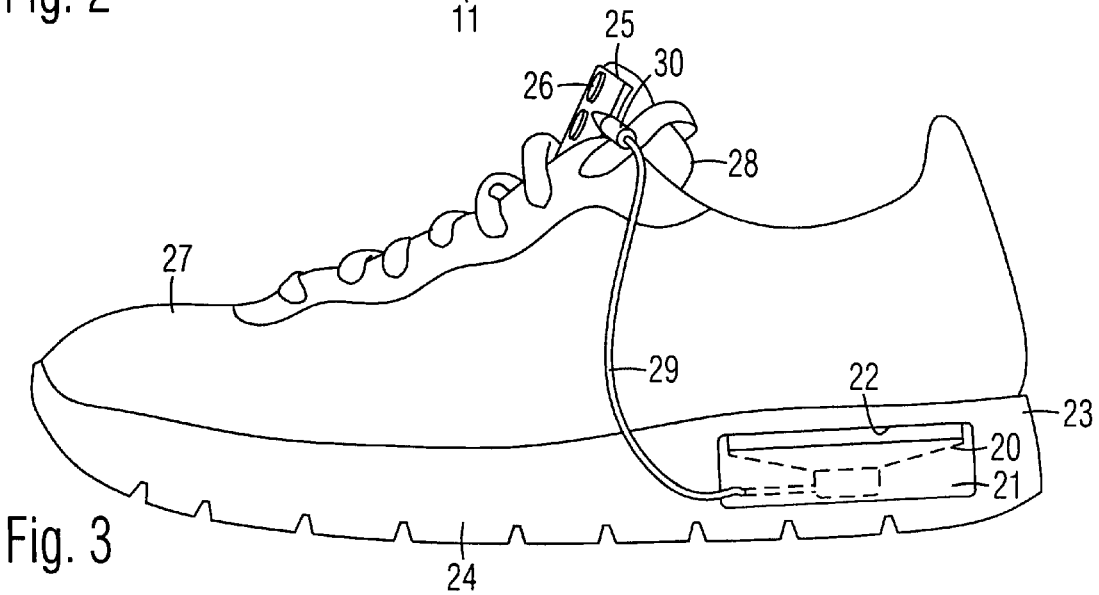
FIG. 3 is a side view of a second embodiment of the audio shoe.

FIG. 3:

A second embodiment of the audio shoe is shown in FIG. 3. It includes a speaker 20 arranged in a housing 21, which is positioned inside a channel 22 extending into a heel portion 23 of a sole 24. An audio module 25 with conventional audio circuitry (not shown) and user controls 26 is attached to any suitable portion of a shoe top 27, such as a tongue 28. Speaker 20 is connected to audio module 25 by a cable 29, preferably with a plug 30.

Figure 4:
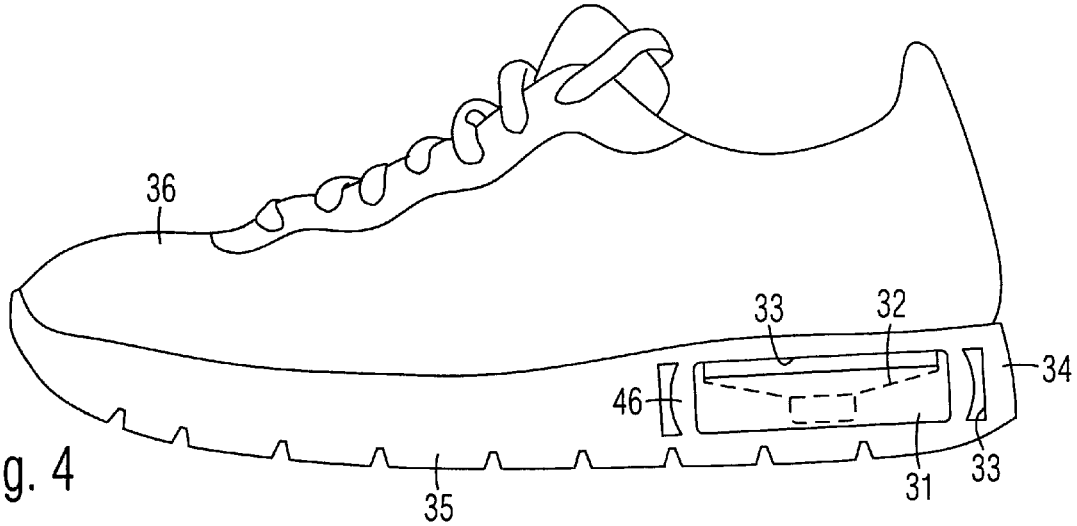
FIG. 4 is a side view of a third embodiment of the audio shoe.

FIG. 4:

A third embodiment of the audio shoe is shown in FIG. 4. It includes a housing 31 with a speaker 32. Housing 31 is positioned in a channel 33 extending into a heel portion 34 of a sole 35. Audio circuitry and user controls (not shown) may be provided in housing 31 or on shoe top 36. Curved, resilient vertical supports 46 extending between top and bottom walls of channel 33 provide additional shock absorption.

Figure 5:
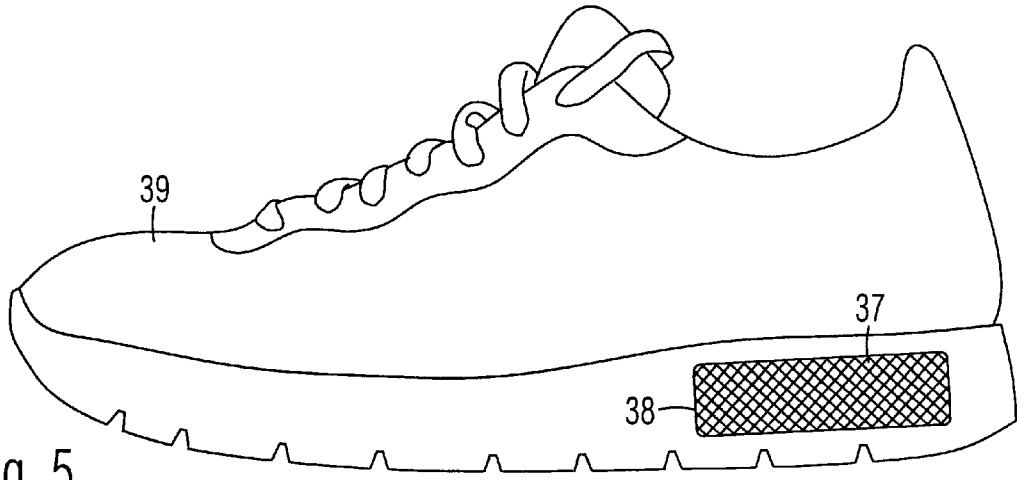
FIG. 5 is a side view of a fourth embodiment of the audio shoe.

FIG. 5:

A fourth embodiment of the audio shoe is shown in FIG. 5. It includes a mesh 37 covering the opening of a channel 38 in which a speaker (not shown) is positioned. Mesh 37 protects the speaker from dirt and water, but still allows sound to escape. Audio circuitry and user controls (not shown) may be positioned in channel 38 or on shoe top 39.

Figure 6:
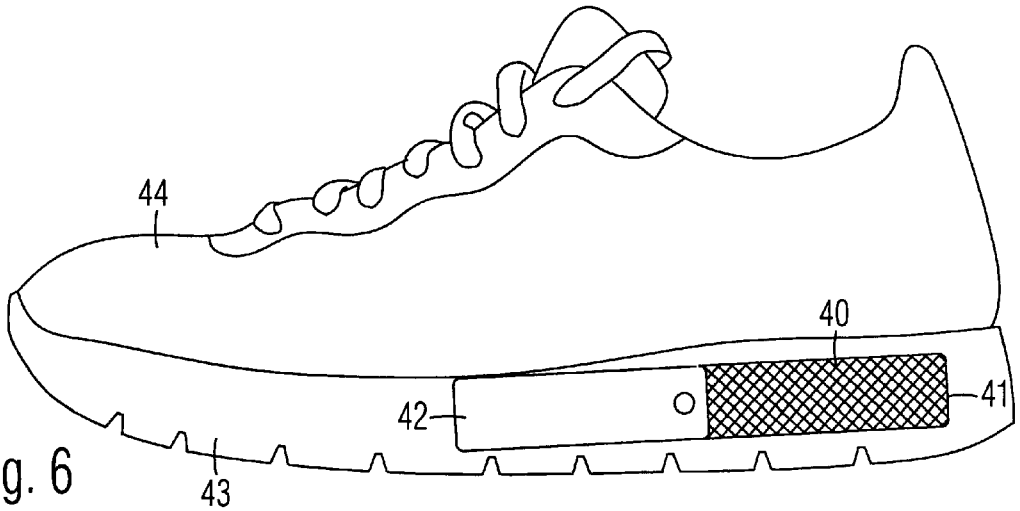
FIG. 6 is a side view of a fifth embodiment of the audio shoe.

FIG. 6:

A fifth embodiment of the audio shoe is shown in FIG. 6. It includes a mesh 40 covering the opening of a channel 41 in which a speaker (not shown) is positioned. Mesh 40 protects the speaker from dirt and water, but still allows sound to escape. A sliding door 42 attached to the side edge of a sole 43 may be slid over mesh 40 to seal off channel 41 from dirt and water, and it may be slid away as shown to enable sound to escape. Audio circuitry and user controls (not shown) may be positioned in channel 41 or on shoe top 44.

SUMMARY AND SCOPE

Accordingly, an audio shoe is provided. It provides audio entertainment and information. It includes a housing which is removable from the shoe for battery replacement. It is easy to operate. It operates reliably in dirty or wet environments. It is as comfortable as a conventional shoe, and it provides enough shock absorption.

Although the above description is specific, it should not be considered as a limitation on the scope of the invention, but only as an example of the preferred embodiment. Many variations are possible within the teachings of the invention. For example, any suitable type of audio circuitry may be used. Any number or type of use controls may be used, or they may be eliminated for completely automatic operation, e.g., whenever the user is walking. The housing may be shaped differently, as long as a slot is provided between the front of the speaker and the side edge of the sole for sound to escape. The speaker may be mounted in the channel without the housing. The channel may be eliminated, and the speaker may be molded into the sole, with only the slot extending from the front of the speaker to the side of the sole. Therefore, the scope of the invention should be determined by the appended claims and their legal equivalents, not by the examples given.

I claim:

1. An audio shoe, comprising:

a shoe top;

a sole attached to a bottom of said shoe top, said sole having a heel portion;

a speaker positioned in said sole, an axis of said speaker being positioned generally vertically, said speaker having a width up to a width of said sole for improved sound volume and quality; and a slot extending from a face of said speaker to a side edge of said sole for allowing sound to escape.

2. The audio shoe of claim 1, wherein said speaker is positioned in said heel portion of said sole.

3. The audio shoe of claim 1, further including audio circuitry connected to said speaker.

4. The audio shoe of claim 1, further including audio circuitry and user controls positioned in said sole.

5. The audio shoe of claim 1, further including an audio module attached to said shoe top and connected to said speaker with a cable.

6. The audio shoe of claim 1, further including an audio module with user controls, said audio module being attached to said shoe top and connected to said speaker with a cable.

7. The audio shoe of claim 1, further including a mesh covering an opening of said slot for resisting entry of contaminants.

8. The audio shoe of claim 1, further including a sliding door covering an opening of said slot for sealing out contaminants.

9. The audio shoe of claim 1, further including a mesh covering an opening of said slot for resisting entry of contaminants, and a sliding door movable across said mesh for positively sealing said slot.

10. An audio shoe, comprising:

a shoe top;

a sole attached to a bottom of said shoe top, said sole having a heel portion;

a channel extending into said sole from a side edge thereof;

a housing positioned in said channel;

a speaker positioned in said housing, an axis of said speaker being positioned generally vertically, said speaker having a width up to a width of said sole for improved sound volume and quality; and a slot extending from a face of said speaker to said side edge of said sole for allowing sound to escape.

11. The audio shoe of claim 10, wherein said speaker is positioned in said heel portion of said sole.

12. The audio shoe of claim 10, further including audio circuitry connected to said speaker.

13. The audio shoe of claim 10, further including audio circuitry and user controls positioned in said housing.

14. The audio shoe of claim 10, further including an audio module attached to said shoe top and connected to said speaker with a cable.

15. The audio shoe of claim 10, further including an audio module with user controls, said audio module being attached to said shoe top and connected to said speaker with a cable.

16. The audio shoe of claim 10, further including a mesh covering an opening of said slot for resisting entry of contaminants.

17. The audio shoe of claim 10, further including a sliding door covering an opening of said slot for sealing out contaminants.

18. The audio shoe of claim 10, further including a mesh covering an opening of said slot for resisting entry of contaminants, and a sliding door movable across said mesh for positively sealing said slot.

19. The audio shoe of claim 10, further including a resilient vertical support extending between an upper wall and a lower wall of said channel for providing additional shock absorption.

20. The audio shoe of claim 10, further including a resilient, curved vertical support extending between an upper wall and a lower wall of said channel for providing additional shock absorption.

* * * * *